US008635768B2

(12) United States Patent
Kapelski

(10) Patent No.: US 8,635,768 B2
(45) Date of Patent: Jan. 28, 2014

(54) MAGAZINE FOR MOUNTING TWIST LOCKS

(75) Inventor: Rainer Kapelski, Boel (DE)

(73) Assignee: Kalp GmbH, Boel (DE)

( * ) Notice: Subject to any disclaimer, the term of this patent is extended or adjusted under 35 U.S.C. 154(b) by 263 days.

(21) Appl. No.: 13/123,850

(22) PCT Filed: Nov. 5, 2009

(86) PCT No.: PCT/DE2009/001565
§ 371 (c)(1),
(2), (4) Date: Apr. 12, 2011

(87) PCT Pub. No.: WO2010/066223
PCT Pub. Date: Jun. 17, 2010

(65) Prior Publication Data

US 2011/0265318 A1 Nov. 3, 2011

(30) Foreign Application Priority Data

Dec. 9, 2008 (DE) ..... 10 2008 061 204

(51) Int. Cl.
*B23Q 7/10* (2006.01)

(52) U.S. Cl.
USPC ..... 29/809; 29/559; 414/331.02; 221/119; 221/277

(58) Field of Classification Search
USPC ..... 29/809, 559, 811.2; 414/311.02, 414/311.04, 331.02, 331.04; 492/36; 221/119–122, 253, 277; 53/77, 158, 53/544
See application file for complete search history.

(56) References Cited

U.S. PATENT DOCUMENTS

| | | | | |
|---|---|---|---|---|
| 2,560,255 | A * | 7/1951 | Shirley | 194/244 |
| 5,097,940 | A | 3/1992 | Manservigi et al. | |
| 2006/0115350 | A1 * | 6/2006 | Weis | 414/139.4 |
| 2008/0093869 | A1 * | 4/2008 | Hay | 294/81.53 |

FOREIGN PATENT DOCUMENTS

| | | |
|---|---|---|
| DE | 3102203 | 8/1982 |
| WO | WO 2004/065264 | 8/2004 |
| WO | WO 2006/024071 | 3/2006 |
| WO | WO 2007/021246 | 2/2007 |
| WO | WO 2007/098749 | 9/2007 |

* cited by examiner

*Primary Examiner* — Jermie Cozart
(74) *Attorney, Agent, or Firm* — Diederiks & Whitelaw, PLC

(57) ABSTRACT

A magazine for mounting twist locks includes a rotatably mounted drum having a plurality of axially oriented elongated guide elements, which are arranged at a distance from each other on the circumference of the drum and the longitudinal axes of which are oriented parallel to each other. The distance between the guide elements is larger than the diameter of a concave section of a respective twist lock and the guide elements form the support for the terminal sections of the twist lock. Closing elements are arranged at each end of the drum and delimit the intermediate spaces formed by the guide elements in the radial direction. One closing element is arranged in a non-rotatable manner and has a radially oriented recess for inserting twist locks between two guide elements in the axial direction.

9 Claims, 2 Drawing Sheets

MAGAZINE FOR MOUNTING TWIST LOCKS

CROSS-REFERENCE TO RELATED APPLICATIONS

This application represents a National Stage application of PCT/DE2009/001565 entitled "Magazine for Mounting Twist Locks" filed Nov. 5, 2009, pending.

BACKGROUND OF THE INVENTION

Field of the Invention

The invention relates to a magazine for mounting twist locks.

Twist locks are mechanical locking elements for connecting containers to each other or containers with the carrier vehicle, e.g. a truck or a container ship. The twist locks are inserted into container fittings, whereupon the container is set down on another container or on locking devices firmly connected to the vehicle, the twist locks semi- or fully automatically forming a positive connection between the containers or the container and the vehicle by a rotating part of the twist locks.

The twist locks consist of two thicker terminal sections that are designed so as to rotate to fulfil the locking function, and between these sections a concave section that is of thinner design than the two thicker terminal sections.

While locking the twist locks is increasingly done in a fully automatic manner, unlocking and removing the twist locks from the container fittings is carried out manually by staff called "lashers". Due to a usually very tight schedule when unloading goods to be transported and due in part to confusing conditions this task is highly accident prone.

For this reason, fully automatic lashing platforms were already proposed, which can be used to remove twist locks—after they have been unlocked manually—therefrom fully automatically without any further staff action and also inserted again. A lashing platform of particularly advantageous design where the energy that is released on setting down the containers onto the platform is used for screwing the twist locks in and out, is for example known from WO 2007/098749 A1.

Such lashing platforms usually also have magazines for taking up and keeping twist locks, which also can be used to store the twist locks carefully. In addition to the printed publication mentioned above, such magazines for twist locks are also known from WO 2006/024071 A1, WO 2007/021246 A1, and WO 2004/065264 A1.

However, the known twist lock magazines have the disadvantage that only special receptacles that need much outlay to produce are provided for twist-lock storing. In addition, very maintenance-intensive chain drives are used for transporting the receptacles to the respective location where they are required.

Other magazines such as the magazine known from DE 41 09 779 A1 for storing products, in particular cigarettes, are not designed for the robust use with twist locks due to their complicated design.

SUMMARY OF THE INVENTION

The object of the present invention is therefore to create a magazine for twist locks that can be manufactured easily, is robust and not prone to fail.

The basic idea of the invention is to design the magazine as a stable, rotatably mounted drum having elongated guide elements arranged thereon between which the concave section of the twist locks is inserted so that the guide elements form the support for the thicker terminal sections of the twist locks. Even when the drum is rotated the twist locks are held by the guide elements on account of the thicker terminal sections arranged on both sides of the concave section and remain in their positions. It is simple to manufacture the magazine, the magazine itself is stable and less prone to fail and requires less maintenance in contrast to known magazines using a chain drive.

BRIEF DESCRIPTION OF THE DRAWINGS

Using an exemplary embodiment of particularly advantageous design the invention is explained in more detail with reference to the attached drawings, in which.

DETAILED DESCRIPTION OF THE PREFERRED EMBODIMENTS

Figure 1:
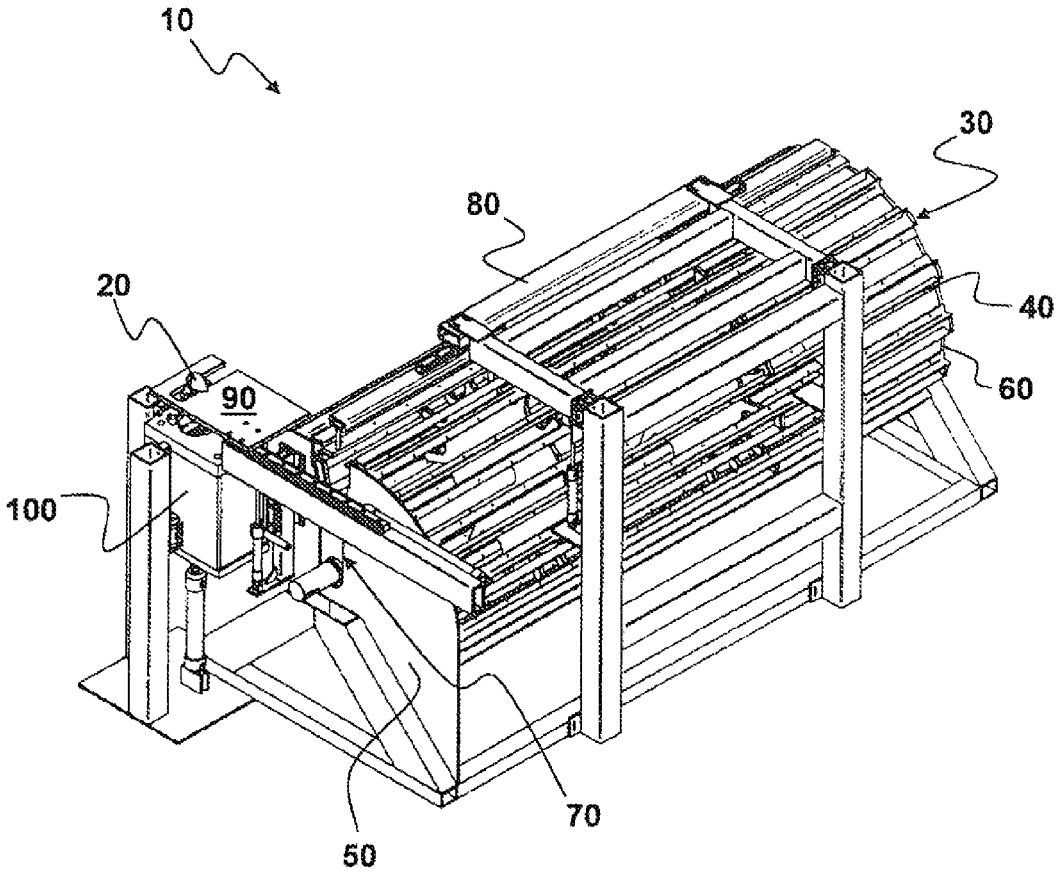
FIG. 1 shows a perspective view of the magazine according to the invention.

FIG. 1 shows a magazine of particularly advantageous design for mounting twist locks according to the invention. The magazine 10 essentially consists of a drum 30 on whose circumference a plurality of axially oriented elongated guide elements 40 is arranged. The guide elements 40 are arranged at a distance from each other and their longitudinal axes are oriented parallel to each other. The distance between the guide elements 40 is selected such that the concave section of the twist lock 20 can be inserted in the axial direction into the intermediate space formed in each case by two guide elements and the upper thicker section of the twist locks 20 is supported on the guide elements. The spacing between the guide elements 40 is thus larger than the diameter of the concave section of the twist locks 20 and smaller than the largest extent of the thicker sections of the twist locks 20. The guide elements 40 thus serve as supports for the terminal sections of the twist locks 20.

In order to ensure that the twist locks 20 cannot be pushed uncontrollably out of the guide elements 40, closing elements 50, 60 are arranged at each end of the drum and delimit the intermediate spaces formed by the guide elements 40 in the radial direction, so that the twist locks 20 cannot fall out of the guide rails 40. In this context according to the invention the one closing element 50 is arranged in a non-rotatable manner and has a radially oriented recess 70 through which the twist locks 20 can be inserted through the closing element 50 between two guide elements 40 in the axial direction.

Both closing elements 50, 60 are preferably disc-shaped but can also be designed to have the shape of a tire. In addition, it is also, possible for the other closing element 60 that has no radially arranged recess to be formed as a plurality of elements that interconnect the front faces of the guide elements 40. In any case it is preferably provided that the other closing element 60 is firmly connected to the drum 30, rotating together with the latter.

Figure 2:
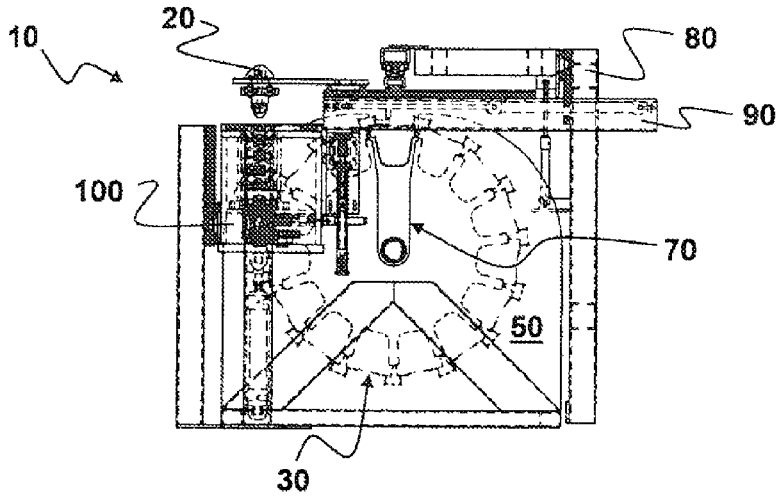
FIG. 2 shows a cut side view of the magazine of FIG. 1.

As illustrated in FIG. 1 and also in FIG. 2, it is particularly preferably provided that the floor of the recess 70 of the one closing element 50 forms the bearing of the axis of the drum 30. This enables a particularly simple construction to be achieved.

For loading and unloading the magazine 10 in a fully automatic manner, the magazine 10 can already be equipped with a control system for automatically loading twist locks 20 into the magazine 10 and unloading them.

In a further advantageous manner a device 80 is then also provided for displacing twist locks 20, stored between the guide elements 40, in the axial direction. This device 80 that resembles a "rake" exhibits an arm that can be displaced in the axial direction of the drum 30 above the drum 30 and that carries one or more pins that engage into that intermediate space formed by two guide elements 40 that opens freely into the radial recess of the closing element 50. By lifting and lowering the arm of the device 80 and displacement in the direction of the other closing element 60 or the one closing element 50, the twist locks 20 arranged in this intermediate space can be pushed further into the magazine 10 or out of the magazine 10.

In case the twist locks 20 are pushed out of the magazine 10, a transfer device 90 is advantageously provided that transports the twist locks 20 between the magazine 10 and a screw device 100 for releasing and/or fastening twist locks 20 on containers. The screw device 100 for releasing and/or fastening twist locks 20 on containers can particularly preferably also be part of the magazine 10 itself.

Using the "rake" 80 the twist locks 20 stored in the magazine between the guide elements 40 are pushed through the radial recess 70 of the one closing element 50 and received by the transfer device 90. In the example illustrated, the transfer device 90 is designed as a movable table that exhibits a receptacle corresponding to the intermediate space formed by the guide elements 40. When a twist lock 20 is pushed into the recess of the table of the transfer device 90, the table can be displaced towards the screw device 100 and the twist lock can be handed over to the screw device 100. It is likewise possible for the table of the transfer device 90 to receive a twist lock on the screw device 100 and transport it to the radial recess of the one closing element 50 where the twist lock 20 is pushed by the "rake" 80 onto the guide elements 40.

Figure 3:
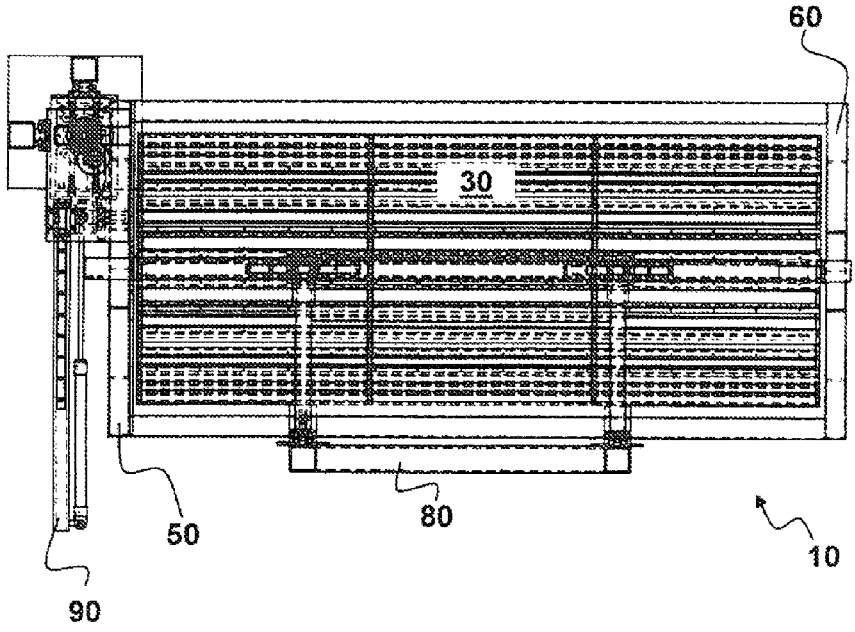
FIG. 3 shows a top view of the inventive magazine.

FIG. 3 clarifies the arrangement once more in a top view.

A lashing platform for containers requires one magazine 10 for each corner of a container. Each magazine 10 is preferably sized such that a total of 15 guide elements 40 having a receiving capacity of 10 deck twist locks or 20 space twist locks are provided for each intermediate space formed by the guide elements 40.

The guide elements 40 are preferably designed as rods or rails, these particularly preferably being supported by further, axially spaced stabilizing elements, care having to be taken that the axial displaceability of the twist locks 20 on the guide elements 40 is not adversely affected. If the stabilizing elements are for example (like the closing elements 50, 60) of disc-shaped design, then care must be taken that the stabilizing elements exhibit radial indentations below each intermediate space guiding a twist lock 20 that are deep enough to ensure unhindered displacement of the twist locks 20 in the magazine 10.

A particularly preferable design of the inventive magazine 10 is obtained if the screw device 100 is designed as a load-bearing container receptacle, i.e. the screw device 100 is designed such that one corner of the container can be set down on the screw device 100. By arranging four inventive magazines 10 in such a type of design of the magazines 10 an arrangement of four magazines 10 can be produced where a container with its four corners can be set down on the four screw devices 100 of the four magazines 10. The advantage of the arrangement mentioned is that in the case of a fault with one screw device 100 or of other parts of the magazine 10 it is not an entire lashing platform that must be replaced but only a single magazine 10 and thus complex storing of lashing platforms or long down times can be avoided.

It is particularly preferable if the screw device 100 that is designed as a load-bearing "container corner rest" is designed with dampeners, air bellows and/or compressors in such a way that they are connected to an air accumulator that stores the energy that is released on lowering a container onto the load-bearing screw device 10 and that transfers it, when required, to the tools that are disposed on the magazine and require energy, e.g. the screw device, the "rake" 80, or the transfer device 90.

The invention claimed is:

1. A magazine for mounting twist locks having concave sections and terminal sections comprising:

a rotatably mounted drum having a plurality of axially oriented elongated guide elements which are arranged at a distance from each other on a circumference of the drum and longitudinal axes which are oriented parallel to each other, wherein a distance between adjacent ones of the plurality of guide elements is larger than a diameter of the concave section of the twist locks and the plurality of guide elements form a support for the terminal sections of the twist locks, and closing elements which are arranged at each end of the drum and delimit intermediate spaces formed by the plurality of guide elements in a radial direction, wherein one of the closing elements is arranged in a non-rotatable manner and has a radially oriented recess for inserting twist locks between two adjacent said guide elements in an axial direction.

2. The magazine according to claim 1, wherein the closing elements are generally flat and parallel to each other.

3. The magazine according to claim 1, wherein another one of the closing elements is firmly connected to and rotates with the drum.

4. The magazine according to claim 1, further comprising: a device for displacing twist locks, stored between the plurality of guide elements, in the axial direction.

5. The magazine according to claim 1, further comprising, in combination: a transfer device for transporting twist locks between the magazine and a screw device for releasing or fastening the twist locks to containers.

6. The magazine according to claim 1, further comprising, in combination: a screw device for releasing or fastening twist locks to containers.

7. The magazine according to claim 6, wherein the screw device is designed as a load-bearing container receptacle.

8. The magazine according to claim 1, further comprising: a control system for automatically loading and unloading the magazine with twist locks.

9. A magazine for mounting twist locks having concave sections and terminal sections comprising:

a rotatably mounted drum having a plurality of axially oriented elongated guide elements which are arranged at a distance from each other on a circumference of the drum and longitudinal axes which are oriented parallel to each other, wherein a distance between adjacent ones of the plurality of guide elements is larger than a diameter of the concave section of the twist locks and the plurality of guide elements form a support for the terminal sections of the twist locks, and closing elements which are arranged at each end of the drum and delimit intermediate spaces formed by the plurality of guide elements in a radial direction, wherein one of the closing elements is arranged in a non-rotatable manner and has a radially oriented recess for inserting twist locks between two adjacent said guide elements in an axial direction, wherein a floor of the recess of the one of the closing elements forms a bearing for the drum.

* * * * *